US005407028A

United States Patent [19]

Jamieson et al.

[11] Patent Number: 5,407,028

[45] Date of Patent: Apr. 18, 1995

[54] TESTED AND REDUNDANT ELEVATOR EMERGENCY TERMINAL STOPPING CAPABILITY

[75] Inventors: Eric K. Jamieson, Farmington; Christopher S. Pietrzykowski, Avon, both of Conn.

[73] Assignee: Otis Elevator Company, Farmington, Conn.

[21] Appl. No.: 54,325

[22] Filed: Apr. 28, 1993

[51] Int. Cl.[6] ..... B66B 5/00

[52] U.S. Cl. ..... 187/288; 187/394; 187/287

[58] Field of Search ..... 187/105, 108, 109, 112, 187/116, 129, 134, 130, 100, 138

[56] References Cited

U.S. PATENT DOCUMENTS

| | | | |
|---|---|---|---|
| 3,379,285 | 4/1968 | Leitz | 187/117 |
| 3,587,785 | 6/1971 | Krauer | 187/29 R |
| 4,067,416 | 1/1978 | Lowry | 187/29 R |
| 4,114,731 | 9/1978 | Faup et al. | 187/29 R |
| 4,161,236 | 7/1979 | Husson | 187/29 R |
| 4,363,381 | 12/1982 | Bittar | 187/29 R |
| 4,898,263 | 2/1990 | Manske et al. | 187/133 |
| 5,070,967 | 12/1991 | Katzy et al. | 187/116 |
| 5,107,964 | 4/1992 | Coste et al. | 187/104 |
| 5,202,540 | 4/1993 | Auer et al. | 187/101 |

*Primary Examiner*—Steven L. Stephan
*Assistant Examiner*—Robert Nappi

[57] ABSTRACT

The main relay that controls power to an elevator motor and brake lift coil is dropped by an electronic emergency stop relay contact placed in series with the elevator safety chain in the event that the speed and position indications in the elevator controller do not agree with the indications of the emergency terminal stopping speed and zone relays, or if the elevator controller indicates the elevator is going too fast when within the emergency terminal stopping zone. Various parts of the safety chain are cycled off when the elevator is at a landing in order to check the safety circuits and main power relays.

7 Claims, 4 Drawing Sheets

TESTED AND REDUNDANT ELEVATOR EMERGENCY TERMINAL STOPPING CAPABILITY

TECHNICAL FIELD

This invention relates to elevator safeties, and more particularly to emergency terminal stopping, at either end of an elevator hoistway.

BACKGROUND ART

It is common in elevators to define a terminal stopping zone as a distance within which, if the elevator has not decelerated sufficiently to indicate that the control system is capable of stopping the elevator, the elevator should be stopped by some emergency means. The presence of the elevator within the emergency terminal zone is typically indicated by means of cams mounted in the elevator hoistway at appropriate positions so as to close switches mounted on the elevator (or vice versa). It is also known that the measurement of speed for determining whether or not emergency terminal stopping should be invoked is typically accomplished by means of a centrifugal switch on the elevator tachometer which provides a signal whenever speed is in excess of a threshold magnitude determined to be indicative of the fact that the elevator is still properly responding to a properly operating controller. Such a speed may, for instance, be 94% of rated contract speed for the given installation. In such a case, if immediately upon entering the emergency terminal zone the elevator speed has not reduced to below 94% of rated speed, then the main operating relay, which provides power to the elevator brake lifting mechanism and the main elevator motor through the safety chain, is disenergized. In addition, most elevators include mechanical safeties, particularly those that operate whenever the elevator overspeeds (such as more than 115% of rated speed).

Elevator code requirements (specified by various governments), such as American National Standard Institute A17.1, Rule 209.2b, require that emergency terminal stopping devices be so designed and installed that a single short circuit caused by a combination of grounds or by other conditions shall not prevent them from functioning. Historically, this requirement has been satisfied through the use of redundant stopping switch contacts above and below the main relay in the safety chain, as well as the use of redundant speed contacts on the governor.

However, even the redundancy does not provide absolute safety because it is possible for contacts to become welded together, or other circuit failures to occur that do not manifest themselves during normal operation, and therefore the failure of which remains unknown. Additionally, the use of stopping switches on an elevator is expensive and difficult to implement in an elevator shaft. The cost of providing safe, emergency terminal stopping is also a consideration.

DISCLOSURE OF INVENTION

Objects of the invention include provision of relatively fail-safe emergency terminal stopping capability which meets code requirements and is relatively low in cost, and provision of emergency terminal stopping capability which is itself capable of being checked so as to provide a much greater assurance of the stopping capability will be functioning when it is required.

According to the present invention, magnets on a floating tape of a tape-driven elevator car position transducer provide an emergency terminal position signal whenever a car is within the emergency terminal zone at either end of an elevator hoistway. According further to the invention, the elevator tachometer provides an independent, centrifugally controller signal indication of car speed being below a threshold magnitude indicative of the likely correct response of the car to proper operation of its controller. In still further accord with the invention, the safety chain which powers the main relay includes contacts responsive to both of these functions, so that should speed be excessive while the car is in the emergency terminal zone, the main relay will disenergized.

According to the invention, various tests of the operability of the emergency terminal stopping capability are performed; the results of these tests can drop the power to the elevator brake lifting coil and motor, and can prevent further operation of the elevator once it has reached a landing after faults have been discovered. According further to the invention, tests of the emergency terminal stopping capability are made as the car approaches a terminal landing, when the car is running at various full speeds, and when the car is stationary at a landing. According still further to the invention, the emergency terminal position sensing capability is checked each time that the car is within the emergency terminal zone to see that the sensing capability indicates that it is within such zone, and is checked when it is not in such zone to see that the sensing capability indicates that the car is not in such zone. Similarly, when the car is operated at rated speed, the safe speed indicating apparatus is checked to see that it indicates that the car is not operating at a safe speed, and when the car is operating below the threshold speed for emergency terminal stopping, the safe speed indicating capability is checked to ensure that it indicates that the speed is below the emergency stopping speed. A variety of other safety features and checking thereof are included in the invention.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
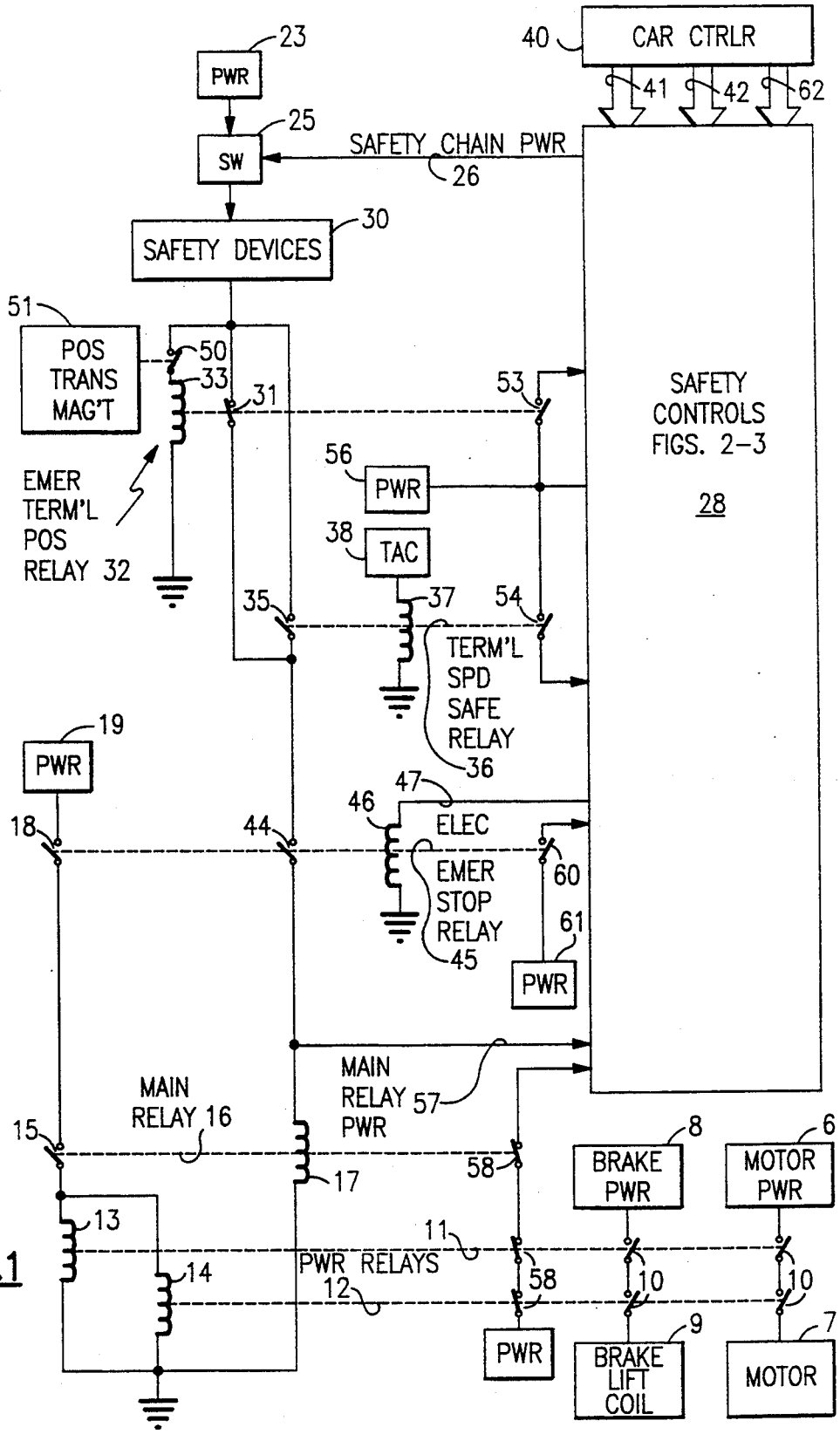
FIG. 1 is a simplified schematic block diagram of a safety system according to the invention.

Referring now to FIG. 1, the motor power 6 for the motor 7 of an elevator, and the brake power 8 for the brake lift coil 9 of the elevator are respectively connected by normally open contacts 10 of respective power relays 11, 12, the coils 13, 14 of which are energized, through a normally open contact 15 of a main relay 16 having a coil 17, and through another contact 18, by a source of power 19. The coil 17 is connected in a safety chain 22 which connects a source of relay power 23 to the coil 17 through a plurality of safety devices. The main relay 16 is used to power the power relays 13, 14 because they are too big to be driven through the safety chain. The first safety device is a solid state switch 25 which may be closed by a signal on a safety chain power line 26 provided by suitable software, such as software within a safety control 28 which may comprise software as described with respect to FIGS. 2–4 hereinafter, which may be implemented in a car controller of the type illustrated generally in U.S. Pat. No. 4,363,381 to Bittar or in an OCSS controller of the type illustrated in U.S. Pat. No. 5,202,540 to Auer et al. The safety chain power signal on line 26 may also be applied to other safety devices, not relevant hereto. When the elevator is to run and there are no safety check faults, the signal on the line 26 closes the switch 25 thereby providing power to the safety chain. The safety chain includes a plurality of safety devices 30 (not shown herein) such as door lock switches, terminal final limit switches, earthquake detectors, and the like. The present invention is concerned with emergency terminal stopping (stopping the elevator at either end of its hoistway in a controlled fashion) and therefore does not concern itself further with the safety devices 30. Next in the safety chain is a parallel path, one path having a normally closed contact 31 of an emergency terminal position relay 32 which includes a coil 33 that is energized whenever the car is within the emergency terminal stopping zone (either top or bottom) of the hoistway. The other path includes a normally open contact 35 of a terminal speed safe relay 36 having a coil 37 that is operated by a centrifugal sensor in a tachometer 38 only when the speed of the elevator is less than, for instance, 94% of rated contract speed. The tachometer 38 is totally independent from the normal primary velocity and position sensor, such as an incremental, digital, rotary encoder driven by a floating tape, which provides velocity and position information to the car controller 40 in order to carry out the desired motion profile and stop at desired landings. Therefore, the velocity and position signals on lines 41 and 42 may be derived from the car controller 40 and used to determine the state that either of the contacts 35, 31 should be in, respectively, as described hereinafter with respect to FIGS. 2–4. Next in the safety chain is a normally open contact 44 of a relay 45 having a coil 46 that is selectively energized or not by a signal on an electronic emergency stop line 47 from the safety control 28. Whenever the safety control determines that the elevator is unsafe while operating, it will remove the signal from the line 47 thereby dropping the electronic emergency stop relay 45, causing the main power relay 16 to be disenergized and opening the circuits to the motor 7 and the brake lift coil 9 so that the elevator will stop. The electronic emergency stop relay 45 also includes the contact 18, for redundant assurance of shutting down the power relays 11, 12. The emergency terminal position relay 32 is itself energized from the safety chain power through a contact 50 which is closed magnetically in a secondary position transducer 51 (or in any other suitable way) whenever the elevator car is within one of the emergency stopping zones at the ends of the hoistway. The safety control 28 monitors the emergency terminal position relay 32 through a normally open contact 53 which receives power from a suitable signal power source 56 (such as 24 volts DC), that also powers a normally open contact 54 of the terminal speed safe relay 36. The fact that main relay power is reaching the main relay through the safety chain is monitored by a main relay power line 57. The power relays 11, 12 and the main relay 16 have normally closed contacts 58 serially connected in a power chain between a source of signal power 59 and the safety controls 28. The electronic emergency stop relay 45 has a normally open contact 60 between a source of signal power 61 and the safety controls 28. The car controller 40 provides additional signals (such as door zone and motion profile signals) to the safety control 28 over lines 62.

The safety checks herein ensure that the elevator car can make an emergency terminal stop if necessary, that it will make an emergency terminal stop one way or another, and that these capabilities can still be monitored. The safety checks are performed at various times: probably the most important time is as the car is approaching a terminal landing.

Figures 2, 3, 4:
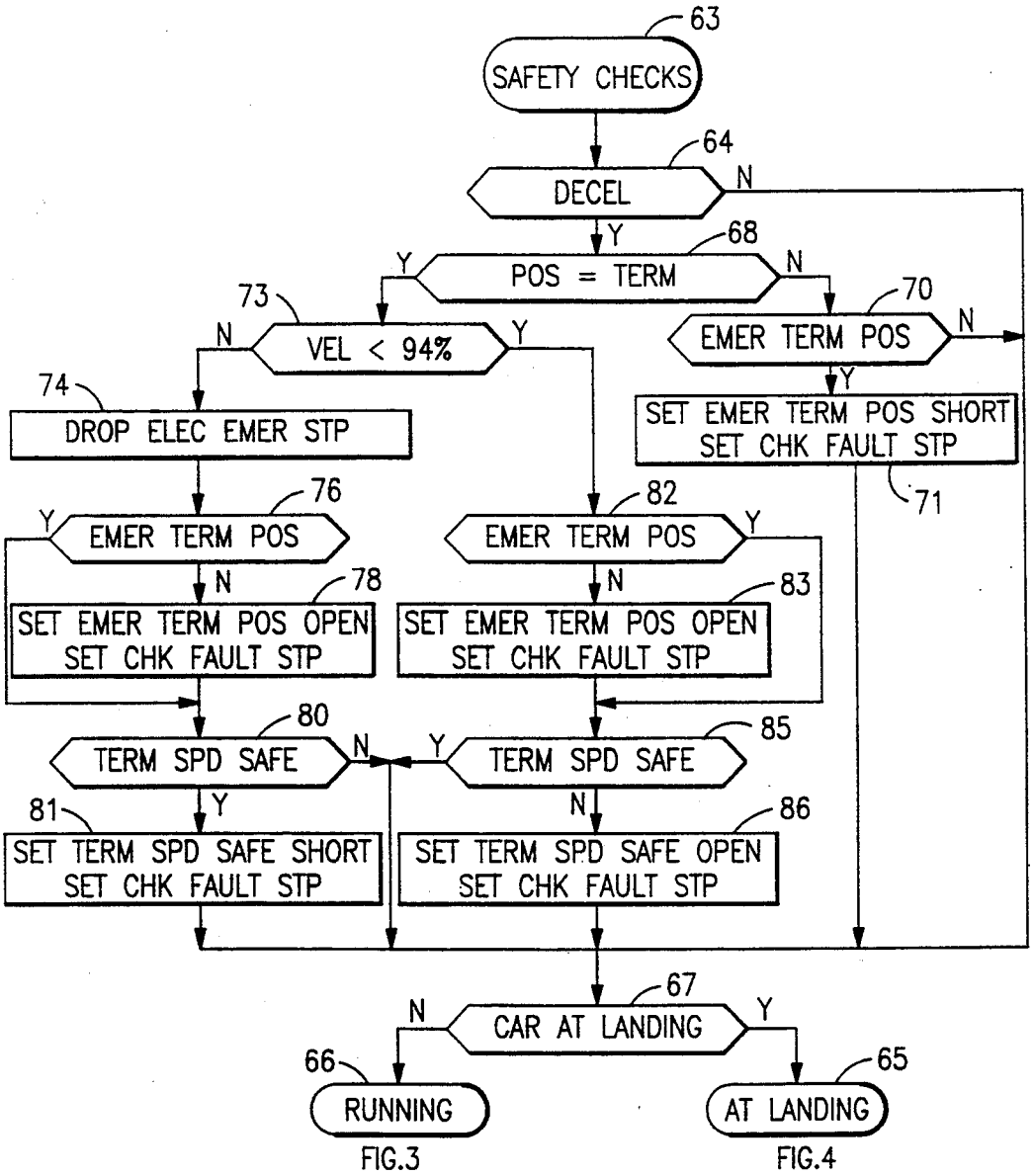
FIGS. 2–4 are logic flow diagrams of routines which may be used in carrying out the present invention (when approaching a terminal, while running, and while at a landing, respectively).
Figure 4B:
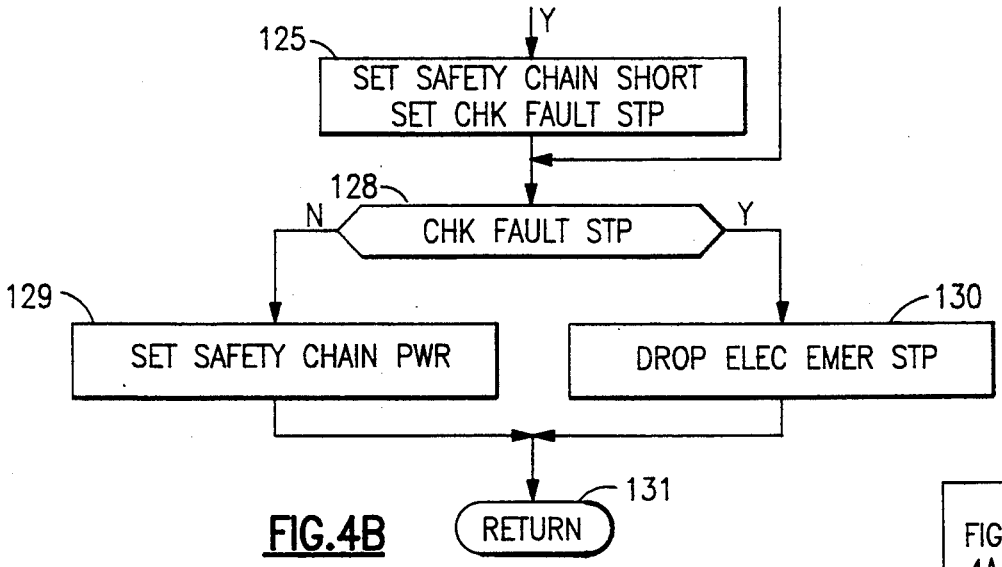
Figure 4:
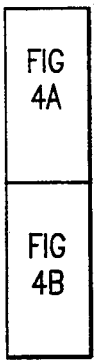
Figure 3:
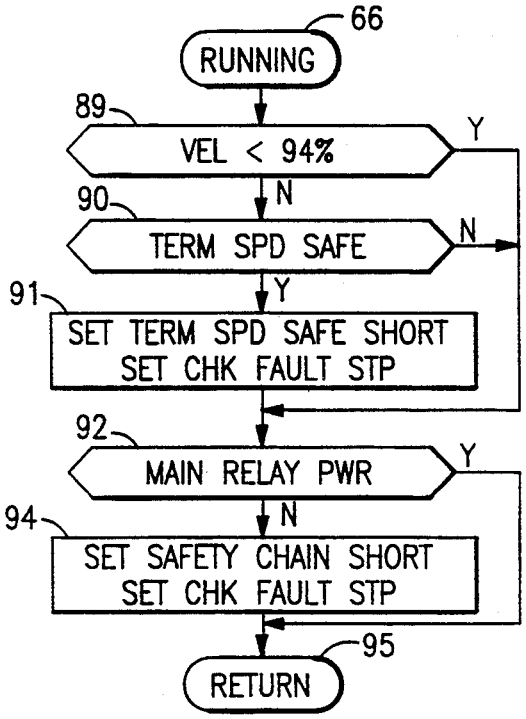
Figure 4A:
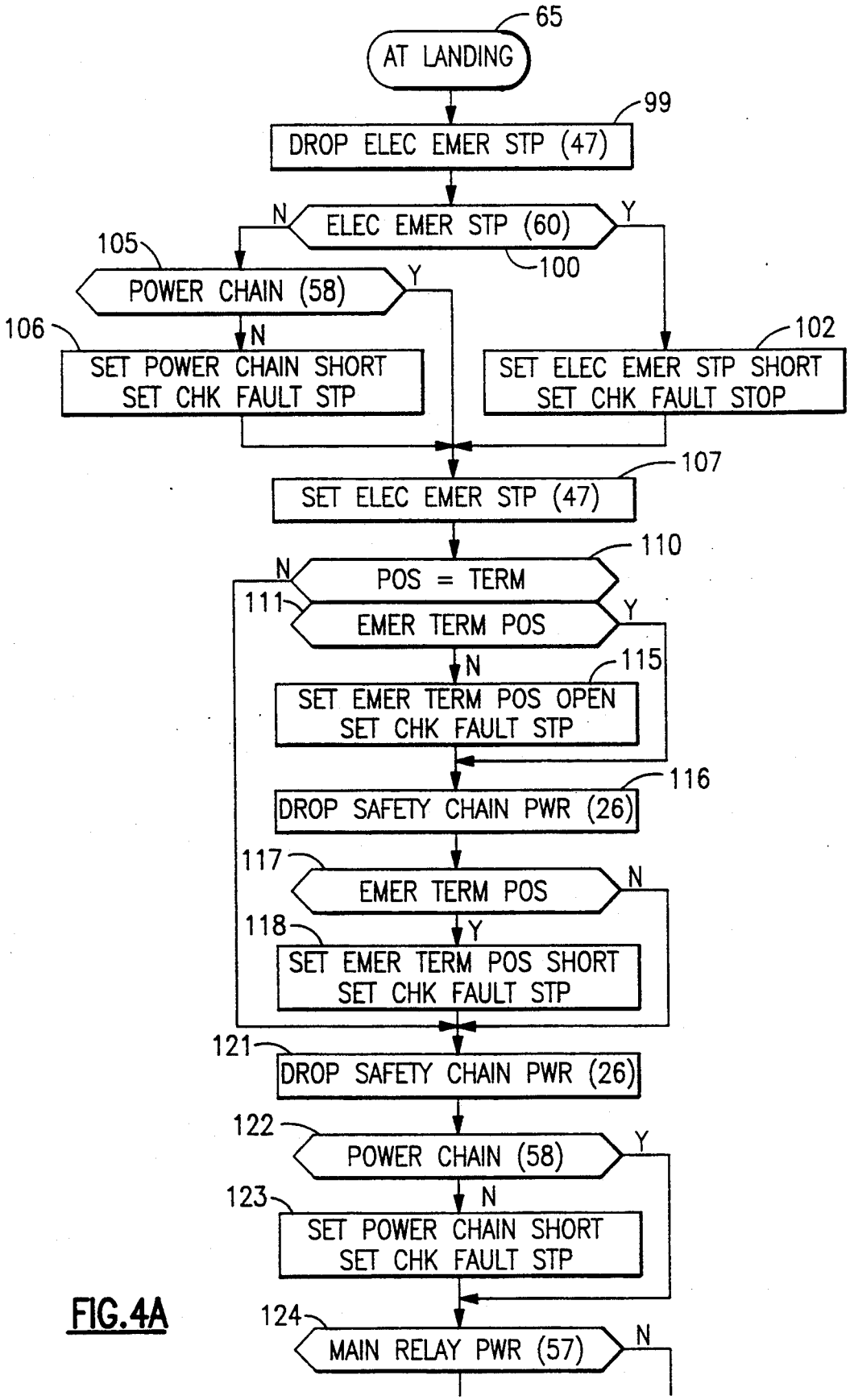

Referring to FIG. 2, safety checks performed at the time that a car is approaching a terminal landing are reached through an entry point 63 and a first test 64 determines if the car is decelerating or not, as determined by the velocity profile indications provided by the car controller 40. If not, the car may be at or leaving the landing, and none of the safety checks for approaching a terminal landing are performed. Instead, the routine will reach the next portion thereof through a transfer point 65 or a transfer point 66 in dependence on whether the car is at a landing or not, as determined by a test 67. This may be accomplished by monitoring a variety of signals, such as position signals (lines 42, FIG. 1) indicating a landing, and door zone signals, zero velocity, and the like.

If the car is decelerating, then a test 68 determines if it is approaching a terminal landing by means of the absolute position signals provided by the car controller 40 over the lines 42. If the car is decelerating into a stop which is not at either end of the hoistway, a negative result of test 68 will reach a test 70 to verify that the emergency terminal position relay 32 agrees that the car is not within the emergency terminal stopping zone at the present time. If the relay is correctly set, it will be disenergized at this time and a negative result of test 70 will reach the transfer test 67. However, if the relay contact 53 indicates that the relay has operated, which could be as a consequence of a short in the switch 50, or other failures, then an affirmative result of the test 70 will reach a pair of steps 71 wherein a flag is set indicating that the emergency terminal position relay is shorted, and a check fault stop flag is set to indicate that the system is no longer viable, so that once the car reaches the next landing, it will be shut down.

Assuming that the car is approaching a terminal landing (that is, one that is at one or the other end of the hoistway), affirmative results of both tests 64 and 68 will reach a test 73 to determine if the car has reached a slow down velocity, which in this example is taken to be 94% of rated contract speed. If the car is still traveling at more than 94% of rated contract speed after it enters the emergency terminal slow down zone (positive results of tests 64 and 68), then a negative result of test 73 will reach a step 74 which causes the electronic emergency stop relay to drop by removing the signal on the line 47, thereby causing the contact 44 to open. This is one of the features of the present invention which provides, in addition to all the other safeties in a safety chain, the ability for the safety control circuits themselves to sense a possible difficulty and remove the main power to assure stopping in the emergency terminal slow down zone. After dropping the electronic emergency stop relay, a test 76 determines if the emergency terminal position relay has operated, thereby opening the contact 31 to remove power from the main relay. If the relay has operated, the terminal 31 will be opened and the system will have shut itself down (probably already has shut itself down). On the other hand, if the relay has not operated, a negative result of test 76 will reach a pair of steps 78 where the emergency terminal position open flag is set and the check fault stop flag is set. If the emergency terminal position relay had in fact operated, an affirmative result of test 76 would bypass the steps 78. Then, a test 80 determines if the terminal speed safe relay has operated or not. In this case, since a negative result of test 73 has indicated that the speed is still excessive, the terminal speed safe relay should not have operated because the tachometer 38 should still be rotating too fast to allow closure of the switch therein that powers the coil 37. Therefore, there should be a negative result from the test 80, and if there is, the program advances through the test 67. But if either the tachometer switch or the relay 36 is faulty, an affirmative result of test 80 will reach a pair of steps 81 to set the terminal speed safe short flag indicating that the terminal speed is closed when it shouldn't be, and to set the check fault stop flag. What has just been described is the condition where the car is supposed to be decelerating into a terminal landing but the speed is still excessive.

In case the car is decelerating to a terminal landing and the speed has reduced below 94% of contract rated speed as the car enters the emergency terminal stop zone, then affirmative results of tests 64, 68 and 73 will reach a test 82 to verify that the emergency terminal position relay has operated, thereby opening the contacts 31. If it has not, then a negative result of test 82 reaches a pair of steps 83 to set the emergency terminal position open flag and to set the check fault stop flag. If however the relay has correctly operated, then an affirmative result of test 82 bypasses the steps 83. Next, a test 85 verifies that the terminal speed safe relay has operated; if it has not, a pair of steps 86 set the terminal speed safe open flag and set the check fault stop flag. But if the terminal speed safe relay 36 has operated properly, an affirmative result of test 85 bypasses the steps 86. Then, the next part of the routine is reached through the test 67.

In FIG. 3, the safety checks which are performed as the car is running are reached through the transfer point 66. As indicated in FIGS. 2 and 3, these two routines are shown as being run contiguously. However, the invention does not require that, and the transfer point 66 could be a return point reaching other parts of the program, as well as being an entry point to reach the safety checks of FIG. 3 from some other part of the program, so long as the "at landing" test is performed first. This is irrelevant to the invention.

In FIG. 3, while the elevator is running at normal speed, a check is made to be sure that the terminal speed safe relay 36 has not operated. Thus a negative result of a test 89 (meaning the speed is more than 94%) reaches a test 90 which should be negative indicating that the terminal speed safe relay has not operated. But if it is positive, the routine reaches a pair of steps 91 which set the terminal speed safe short flag and the check fault stop flag. If the relay has not operated, the steps 91 are bypassed. Then a test 92 monitors whether or not there still is main relay power as indicated on the line 57. If there is not, then a step 94 is reached which sets a safety chain short flag to indicate that the problem is a short somewhere along the safety chain which has caused a loss of power. If the power is all right, an affirmative result of test 92 will bypass the step 94. Then the next part of the program is reached through a transfer point 95. As described hereinbefore, this may return to the safety checks of FIG. 2 or it may be other parts of the program, as suits any implementation of the present invention.

In FIG. 4, the safety checks which are performed periodically, while the car is at a landing, are reached through the transfer point 65. When the car is at a landing, the safety controls take the opportunity to cycle the main power off and make certain checks that cannot be made when the elevator is running. It also checks the check fault stop flag which may be set as described hereinbefore and hereinafter for any number of reasons, and if the flag has been set, further operation of the elevator car is prevented. In FIG. 4, a first step 99 causes the electronic emergency stop relay 45 to be disenergized by dropping the signal on the line 47. Then, a test 100 determines if the normally open contact 60 of the electronic emergency stop relay is still providing power. If it is, this indicates that there is something wrong with the electronic emergency stop relay so a pair of steps 102 will set a electronic emergency stop short flag and the check fault stop flag. But if the contact is open, then a negative result of test 100 will reach a test 105 to determine if power is still being applied from the signal power source 59 through the power chain of normally closed relays 58. If it is not, this indicates that one of the relays 11, 12, 16 is hung up in the operated condition so a negative result of test 105 will reach a pair of steps 106 to set a power chain short flag and the check fault stop flag. But if all three of the relay contacts 58 are closed, indicating that each relay is disenergized, then an affirmative result of test 105 will bypass the steps 106. After performing the tests with electronic emergency stop removed, a step 107 restores power to the electronic emergency stop relay so that tests may be made with or without dropping the safety chain power. A first test 110 determines if the car position is at or near a terminal landing, or not. If it is, an affirmative result of test 110 reaches a test 111 to determine if the emergency terminal position relay 32 has operated or not. If it has not, then it indicates a fault and a negative result of test 111 reaches a pair of steps 115 in which the emergency terminal position open flag and the check fault stop flag are set. But if the emergency terminal position relay has operated properly, an affirmative result of test 111 bypasses the steps 115. In either event, the next step 116 causes the safety chain power to be dropped by removing the signal from the line 26 causing the switch 25 to open. Then, the emergency terminal position relay is checked again in a test 117 with the power removed from the safety chain; the relay coil 33 should have become disenergized despite switch contact 50 being closed. If it is still energized, this may be because the switch 25 is shorted or because the relay 32 is unable to transfer to the disenergized position. In any event, an affirmative result of test 117 will reach a pair of steps 118 where the emergency terminal position short flag and the check fault stop flag are set. If the relay has indicated that it is disenergized, a negative result of test 117 bypasses the steps 118.

If the car is at a non-terminal landing, the steps and tests 111–118 are bypassed. In either case, the next step 121 will drop the safety chain power by removing the signal on the line 26 and opening the switch 25 (the same as step 116). If the step 116 had just been performed, step 121 will be redundant; but if the steps and tests 111–118 have been bypassed, the step 121 is necessary. When the safety chain power is off, a test 122 determines if the power chain (the normally closed contacts 58) are all closed. Since all three relays 11, 12, 17 should be disenergized, the contacts 58 should all be closed. If they are not, a pair of steps 123 will set the power chain short flag and the check fault stop flag; otherwise these steps are bypassed by an affirmative result of test 122. Then a test 124 determines if main relay power is still being indicated on the line 57. If it is, this means there is some combination of short circuits providing power to the line in an impermissible fashion, so an affirmative result of test 124 will reach a pair of steps 125 which set a safety chain short flag and the check fault stop flag; otherwise, these steps are bypassed.

Each time that a car is at a landing, all of the safety checks which have been described are checked to determine whether any check fault has been sensed, thereby setting the check fault stop flag. In a test 128, if the health of the system is verified by a negative result, safety chain power is reestablished by a signal on the line 26 as a result of a step 129. If there is any fault indicated, however, an affirmative result of the test 128 will reach a step 130 where the electronic emergency stop relay 45 is dropped by removing the signal on the line 47, so there will be an open contact 44 redundantly removing power from the main relay 16. Then, other programs are reached through a return point 131.

It should be understood that not every possible test and feature described herein need be utilized in order to take advantage of certain of the tests or features hereof. And, even though certain of the contacts are tested in a way to determine if they are closed, similar tests can be performed by determining if contacts are open. Thus, the test for the presence of an affirmative condition may alternatively be performed by testing for the absence of a negative condition, if desired, in any given implementation of the present invention. The numbers of relays used and tested are typical, but these of course need not be the same in order to take advantage of the invention.

As described herein, the nature of each fault which causes setting the check fault stop flag is identified by setting a corresponding flag (such as the emergency terminal position open flag of steps 78 in FIG. 2). These can be utilized for diagnostic purposes. Of course, in FIG. 3, the absence of main relay power in test 92 is not an emergency condition, since the elevator car will already have been shut down; however, recording the fact that main power was missing by virtue of the steps 94 is useful for diagnostics. A main switch in the present case comprises all of the relays 11, 12 and 16. The relay 16 is used to energize the relays 13 and 14 because those relays are of such a large size that it would be inadvisable to operate their coils by means of current which passes through the entire safety chain, as described hereinbefore. However, other arrangements for main switching of the brake and motor power may be made while still taking full advantage of various aspects of the present invention, in a way that is obvious following the teachings herein. Of course, if it is not desired to keep track of the nature of any check fault stop, then the corresponding different flags need not be set.

There are principal capabilities provided herein, including the emergency terminal stopping capability provided by the relays contacts 31 and 35, as well as redundancies of those capabilities, such as opening the contact 44 in the event that the position indication does not agree with the emergency terminal position relay. And, checking all of these features to see that they are operative or not operative, in an appropriate manner at appropriate times is an important aspect of the invention. This provides a great deal of confidence in the operability of the redundant systems herein.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of providing and checking an emergency terminal stopping capability for an elevator car having a main switch that is normally energized to provide power to the motor and brake lift coil of said car, said car being controlled to move among and stop at floors being served thereby, comprising:

(a) providing an emergency terminal position signal either indicating a first position condition in which the car is within an emergency terminal zone at either end of the elevator hoistway or alternatively indicating a second position condition in which the car is not within said zone;

(b) providing a terminal safe speed signal either indicating a first speed condition in which the car is traveling at a speed below a threshold speed which demonstrates that the car is slowing down correctly in response to normal controls as it approaches a terminal landing or alternatively indicating a second speed condition in which the car is traveling at a speed in excess of said threshold;

(c) providing a position signal indicative of the position of the car within the hoistway;

(d) providing a velocity signal indicative of the speed of the car;

(e) providing, in response either to said emergency terminal position signal indicating one of said position conditions concurrently with said position signal indicating a position inconsistent with said one position condition or to said terminal safe speed signal indicating one of said speed conditions concurrently with said velocity signal indicating a speed inconsistent with said one speed condition, a check fault signal; and (f) in response to said check fault signal being present any time that said car is stopped at a landing, preventing said main switch from being energized, thereby preventing power from being applied to said motor and said brake lift coil.

2. A method according to claim 1, comprising:

in response to said velocity signal indicating a speed in excess of said threshold speed concurrently with said position signal indicating that said car is within one of said emergency stopping zones, disenergizing said main switch, thereby removing power from said motor and said brake lift coil.

3. A method according to claim 1, comprising:

in response to said terminal safe speed signal indicating a speed in excess of said threshold speed concurrently with said emergency terminal position signal indicating said first position condition, disenergizing said main switch, thereby removing power from said motor and said brake lift coil.

4. Safety apparatus for an elevator having a car, a motor for driving the car, and a brake including a brake lift coil, comprising:

a main switch for normally providing power to said motor and to said brake lift coil;

a safety chain for normally providing power to said main switch so as to cause said main switch to allow power to be provided to said motor and to said brake lift coil, said safety chain including parallel relay contacts that interrupt the power to said main switch in the event that the elevator car is within an emergency terminal stopping zone at either end of the elevator hoistway unless the elevator is traveling at a speed below a threshold speed which demonstrates that the car is slowing down correctly in response to normal controls as it approaches a terminal landing; and a car controller including means to provide a position signal indicative of the position of the car within the hoistway and a velocity signal indicative of the speed of the car;

characterized by the improvement comprising:

an electronic emergency stop relay having a contact in series with said set of parallel contacts in said safety chain and effective, when open, to disable said main switch and remove power from the motor and the brake lift coil, said electronic emergency stop relay being operable to close said contact in response to an electronic emergency stop relay signal which is normally present; and signal processing means for normally providing said electronic emergency stop relay signal to said electronic emergency stop relay so as to cause it to close said electronic emergency stop contact, and responsive to said velocity signal indicating elevator speed in excess of said threshold concurrently with said position signal indicating elevator position within one of said zones for ceasing to provide said electronic emergency stop relay signal.

5. Safety apparatus according to claim 4, further comprising:

additional relay contacts, each operated in conjunction with a corresponding one of said parallel relay contacts; and wherein said signal processing means comprises means for comparing the velocity and position signals provided by said car controller with the states of said additional relay contacts, and for ceasing to provide said electronic emergency stop relay signal in response to said velocity and position signals indicating a combination of speed and position which is inconsistent with the states of said additional relay contacts.

6. Safety apparatus according to claim 4 wherein:

said parallel relay contacts include a contact operated by a given relay powered through a portion of said safety chain; and said signal processing means comprises means responsive to said position signal indicating that the elevator car is at a terminal landing for removing power from said safety chain and determining if said given relay is in an operated state, and for ceasing to provide said electronic emergency stop signal if said given relay is in said operated state with power removed from said safety chain.

7. A method according to claim 1, comprising:

while said car is stopped at a landing, removing power from said safety chain, determining if said main switch is in said open condition, and providing said check fault signal unless said main switch is in said open condition.

* * * * *